US007829829B2

(12) United States Patent
King et al.

(10) Patent No.: US 7,829,829 B2
(45) Date of Patent: Nov. 9, 2010

(54) GRID FIN CONTROL SYSTEM FOR A FLUID-BORNE OBJECT

(75) Inventors: Michael J. King, Gloucester, MA (US); Jerome P. Fanucci, Lexington, MA (US)

(73) Assignee: Kazak Composites, Incorporated, Woburn, MA (US)

( * ) Notice: Subject to any disclaimer, the term of this patent is extended or adjusted under 35 U.S.C. 154(b) by 12 days.

(21) Appl. No.: 12/215,180

(22) Filed: Jun. 25, 2008

(65) Prior Publication Data

US 2009/0045286 A1 Feb. 19, 2009

Related U.S. Application Data

(60) Provisional application No. 60/937,305, filed on Jun. 27, 2007.

(51) Int. Cl.
*F42B 15/01* (2006.01)

(52) U.S. Cl. ..... 244/3.25; 244/3.24

(58) Field of Classification Search ..... 244/3.25, 244/3.24, 3.27, 3.21, 3.28
See application file for complete search history.

(56) References Cited

U.S. PATENT DOCUMENTS

| | | | | |
|---|---|---|---|---|
| 1,335,527 | A | | 3/1920 | Plym |
| 2,115,504 | A | | 4/1938 | Wallis |
| 2,378,885 | A | | 6/1945 | Watter |
| 2,597,703 | A | * | 5/1952 | Busacker ..... 244/3.25 |
| 2,734,586 | A | | 2/1956 | Wright et al. |
| 3,047,259 | A | * | 7/1962 | Tatnall et al. ..... 244/138 A |
| 3,119,333 | A | | 1/1964 | Loughran |
| 3,135,203 | A | | 6/1964 | Halsted et al. |
| 3,867,893 | A | * | 2/1975 | Saholt et al. ..... 114/20.1 |
| 4,737,527 | A | | 4/1988 | Maranci |
| 5,048,773 | A | | 9/1991 | Washington et al. |
| 5,429,853 | A | | 7/1995 | Darrieux |
| 5,498,160 | A | * | 3/1996 | Farina et al. ..... 434/12 |
| 5,501,414 | A | | 3/1996 | Bauer |
| 5,897,078 | A | | 4/1999 | Burnham et al. |
| 6,123,289 | A | * | 9/2000 | Manole et al. ..... 244/3.24 |
| 6,190,484 | B1 | | 2/2001 | Appa |
| 6,460,807 | B1 | * | 10/2002 | Braitinger et al. ..... 244/133 |
| 6,928,715 | B2 | | 8/2005 | Fanucci et al. |
| 7,243,879 | B2 | | 7/2007 | Fanucci et al. |
| 2004/0108412 | A1 | * | 6/2004 | Moore et al. ..... 244/3.24 |
| 2007/0102568 | A1 | * | 5/2007 | Higgins et al. ..... 244/3.25 |

* cited by examiner

*Primary Examiner*—Christopher P Ellis
(74) *Attorney, Agent, or Firm*—Weingarten, Schurgin, Gagnebin & Lebovici LLP

(57) ABSTRACT

A grid fin control system for a fluid-borne body includes a nozzle extension, an optional stabilization device, and a plurality of grid fins. The grid fins are stowable folded against the nozzle extension and deployable to extend radially outwardly.

8 Claims, 7 Drawing Sheets

GRID FIN CONTROL SYSTEM FOR A FLUID-BORNE OBJECT

CROSS REFERENCE TO RELATED APPLICATIONS

This application claims the benefit under 35 U.S.C. §119(e) of U.S. Provisional Application No. 60/937,305, filed on Jun. 27, 2007, the disclosure of which is incorporated by reference herein.

STATEMENT REGARDING FEDERALLY SPONSORED RESEARCH OR DEVELOPMENT

N/A.

BACKGROUND OF THE INVENTION

Lattice or grid fins are known for controlling fluid-borne objects, such as missiles, in flight. See U.S. Pat. No. 6,928,715. In particular, missiles can experience a state of instability during flight due to a center of pressure/center of gravity mismatch, and can thus benefit from a level of control authority at the tail. One way to stabilize the missile and provide more control authority is to add lattice or grid fins to the aft portion of the missile.

SUMMARY OF THE INVENTION

A lattice or grid fin control system for a fluid-borne object is provided. The grid fin control system includes a nozzle extension mountable to a tail of the fluid-borne object. The nozzle extension preferably tapers outwardly and rearwardly from the tail to accommodate aerodynamic conditions of the reaction products discharging from the propulsion system of the object and to maximize the radial deployment distance of the deployed fins in the shortest axial folded length. A stabilization device is optionally mounted at the aft edge of the nozzle extension to extend radially outwardly from the nozzle extension, minimizing clearance between the fluid-borne object and a launch tube or canister and thereby stabilizing the fluid-borne object within and during its passage through the canister. A plurality of lattice or grid fins are mounted to the nozzle extension, or to the stabilization device if present, for movement from a stowed position folded against the nozzle extension to a deployed position extending radially outwardly from the nozzle extension.

DESCRIPTION OF THE DRAWINGS

The invention will be more fully understood from the following detailed description taken in conjunction with the accompanying drawings in which.

DETAILED DESCRIPTION OF THE INVENTION

Figure 1A:
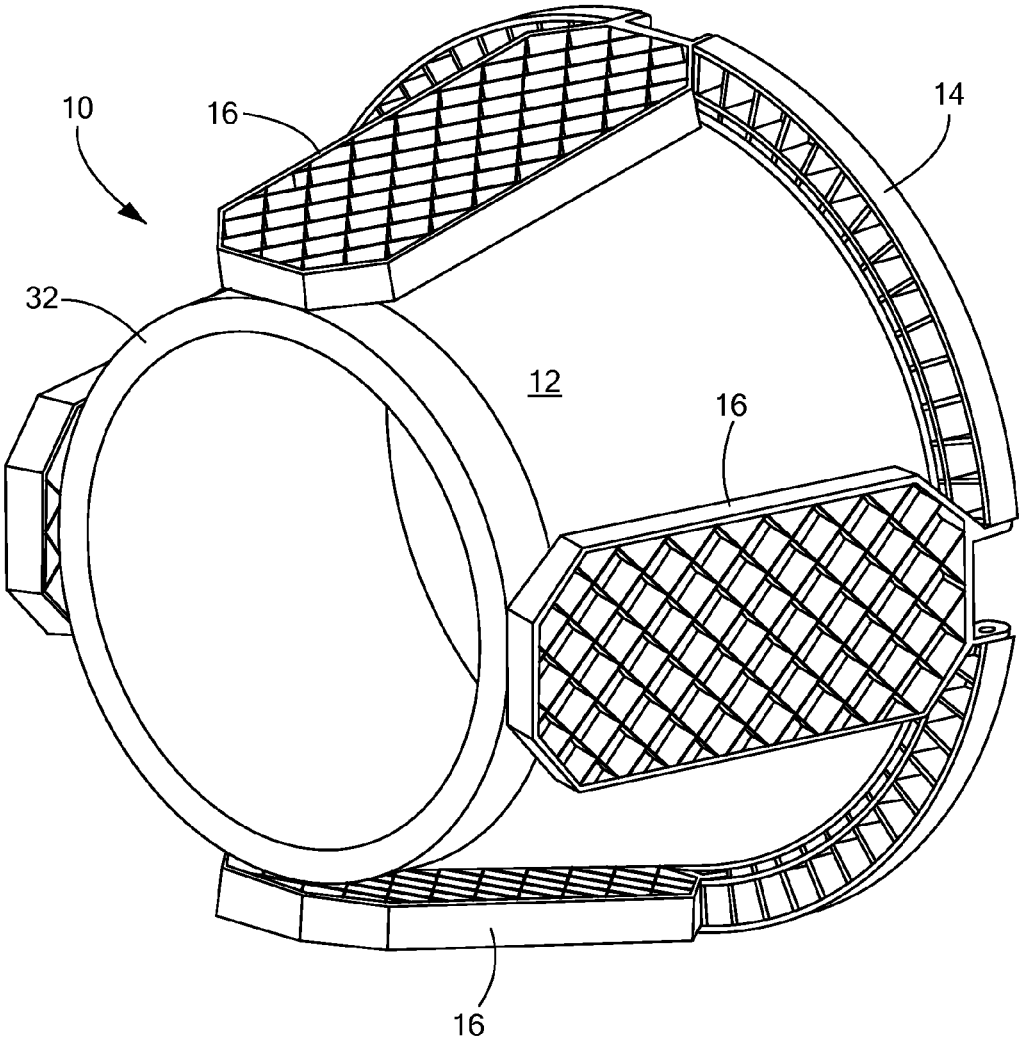
FIG. 1A is an isometric view of a grid fin control system in a stowed configuration.
Figure 1B:
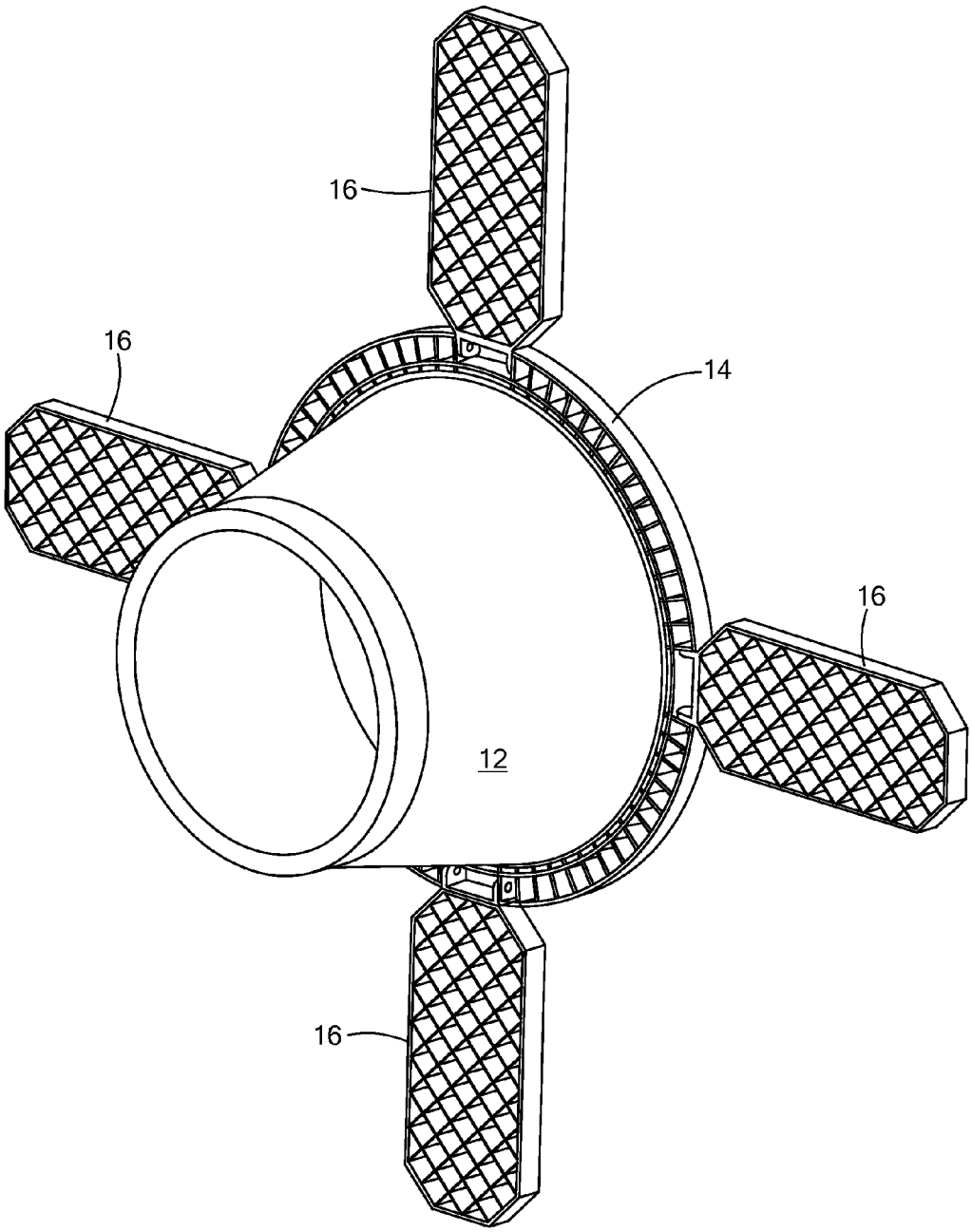
FIG. 1B is an isometric view of the grid fin control system of FIG. 1A in a deployed configuration.

The grid fin control system (GFCS) 10 incorporates two, or optionally three, components: a nozzle extension 12, an optional stabilization device 14, such as a ring, and the lattice or grid fins 16. See FIGS. 1A and 1B. FIG. 1A illustrates the GFCS in a stowed configuration, in which the grid fins lay against the nozzle extension. FIG. 1B illustrates the GFCS in a deployed configuration, in which the grid fins extend radially outwardly.

Figure 2:
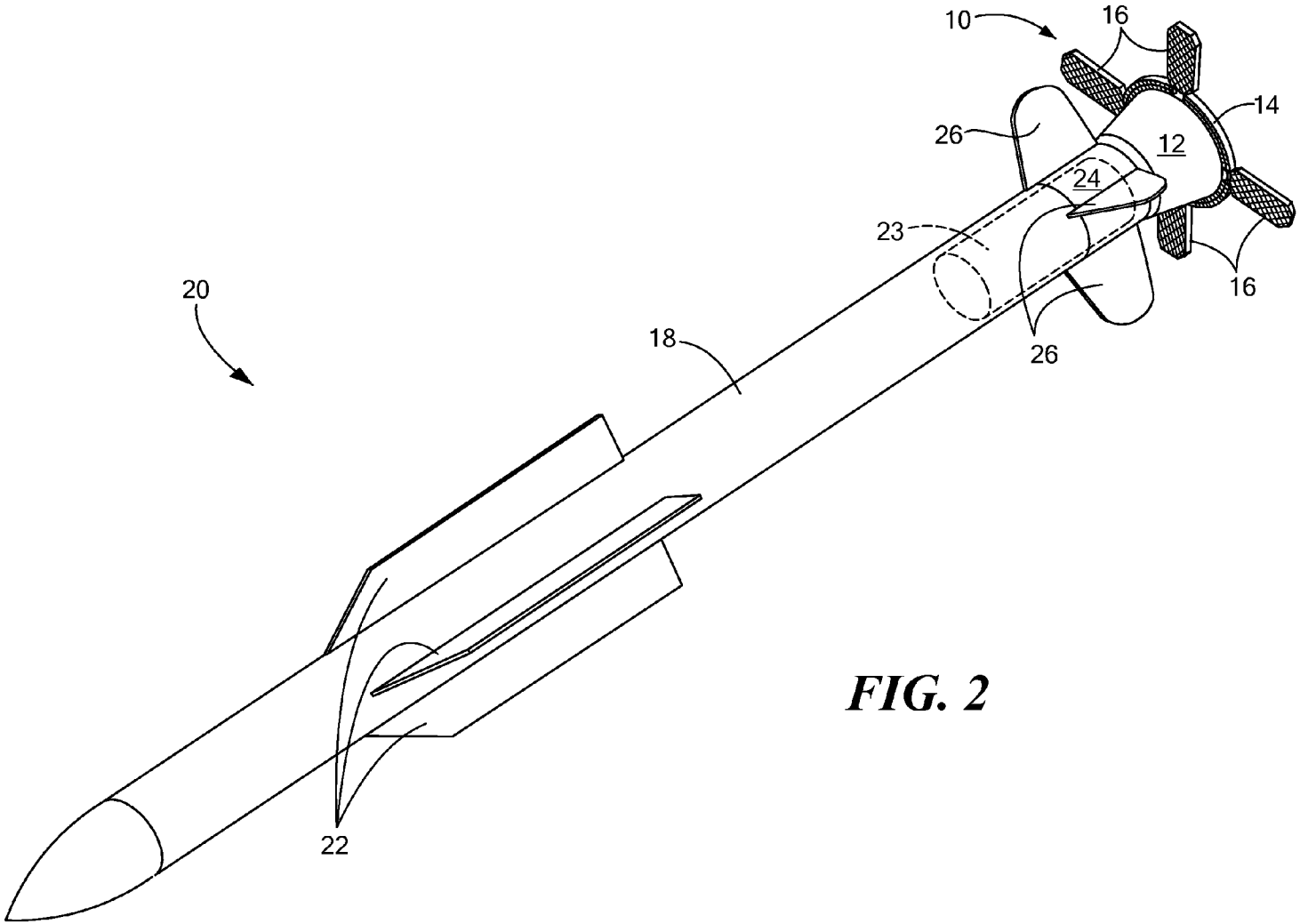
FIG. 2 is an isometric view of a grid fin control system installed on a fluid-borne object.

FIG. 2 illustrates the GFCS integrated on a fluid-borne object 20, such as a missile. In the embodiment illustrated, the missile includes an elongated body 18 having longitudinally extending dorsal fins 22 generally in a forward or mid portion of the body. A propulsion system 23 is disposed internally within the body that directs the reaction products out of a propulsion nozzle 24 at the tail or the aft portion of the body. Tail fins 26 are disposed on the propulsion nozzle. The object is launched from, for example, a launch tube or canister (described further below). The tail fins may lay flat against the propulsion nozzle and deploy to the radially extending position illustrated upon exiting the launch canister. It will be appreciated, however, that the grid fin control system can be employed with fluid-borne objects of other forms and types.

Figure 5:
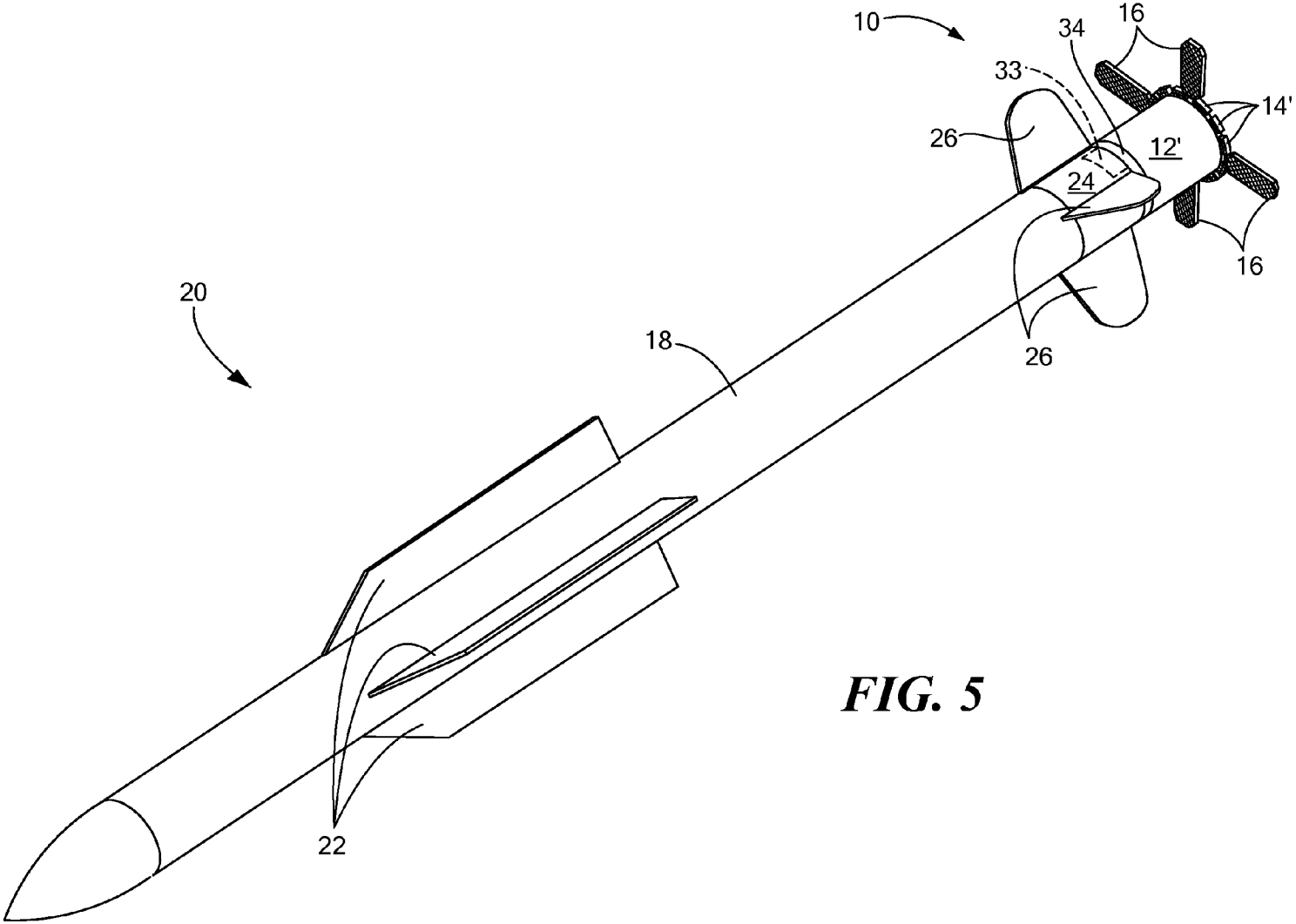
FIG. 5 is an isometric view of a grid fin control system installed on a fluid-borne object illustrating further aspects of the present invention.

The nozzle extension 12 has the form of a hollow cylinder or cone mounted to the nozzle 24 at the aft end or tail of the body 18. The nozzle extension extends rearwardly away from the body. Preferably, the nozzle extension is tapered to match the taper of the propulsion nozzle to minimize detrimental effects of the exhaust plume aerodynamics. Tapering the nozzle extension outwardly also maximizes the radial deployment distance of the deployed fins in the shortest axial folded length. FIG. 5 illustrates a nozzle extension 12' extending straight rearwardly from the tail of the fluid-borne body. The nozzle extension can be formed of any suitable materials, such as a metal or composite material.

The nozzle extension can be mounted to the tail of the body with any suitable mounting device. For example, a clamp 32 may be fastened around the outer surface of the tail of the body. The mounting device can retain the extension to the body during the entire flight, or it can eject or jettison the extension from the body when the extension is no longer required. In the latter case, a controllable link 33 between the propulsion nozzle and the nozzle extension can be provided to operate a releasable mechanism 34 of the mounting device to control the ejection of the nozzle extension at a suitable time. (See FIG. 5.)

The optional stabilization device 14, if present, is disposed at the aft end of the nozzle extension 12 where it provides stability to the missile 20 while it is stored and during launch from the canister. The clearance between the outer diameter of the stabilization device and the inner surfaces of the canister is minimal, which keeps the tail of the missile body centered in the canister.

Figure 4A:
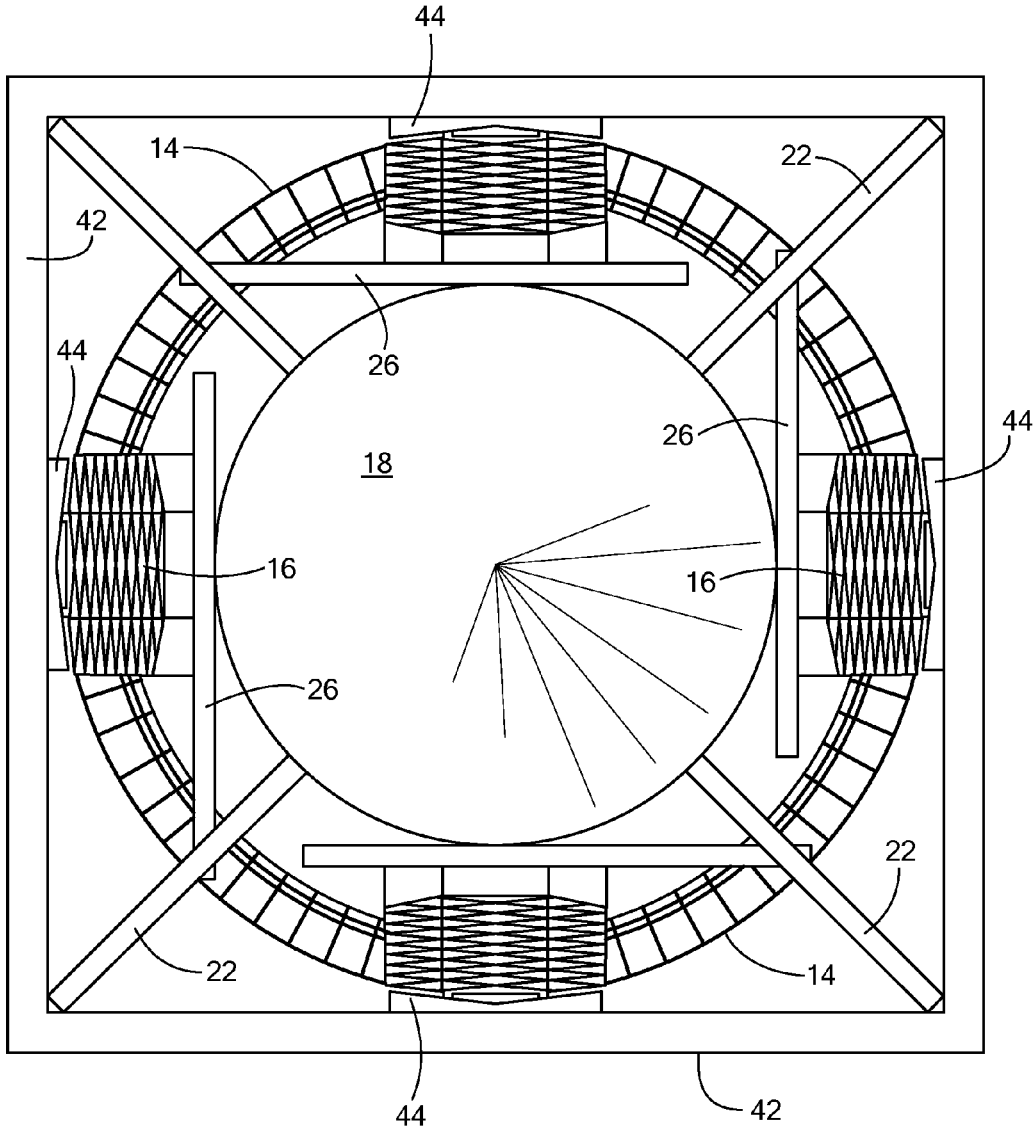
FIG. 4A is a front view of a fluid-borne object with the grid fin control system in a launch tube or canister.
Figure 4B:
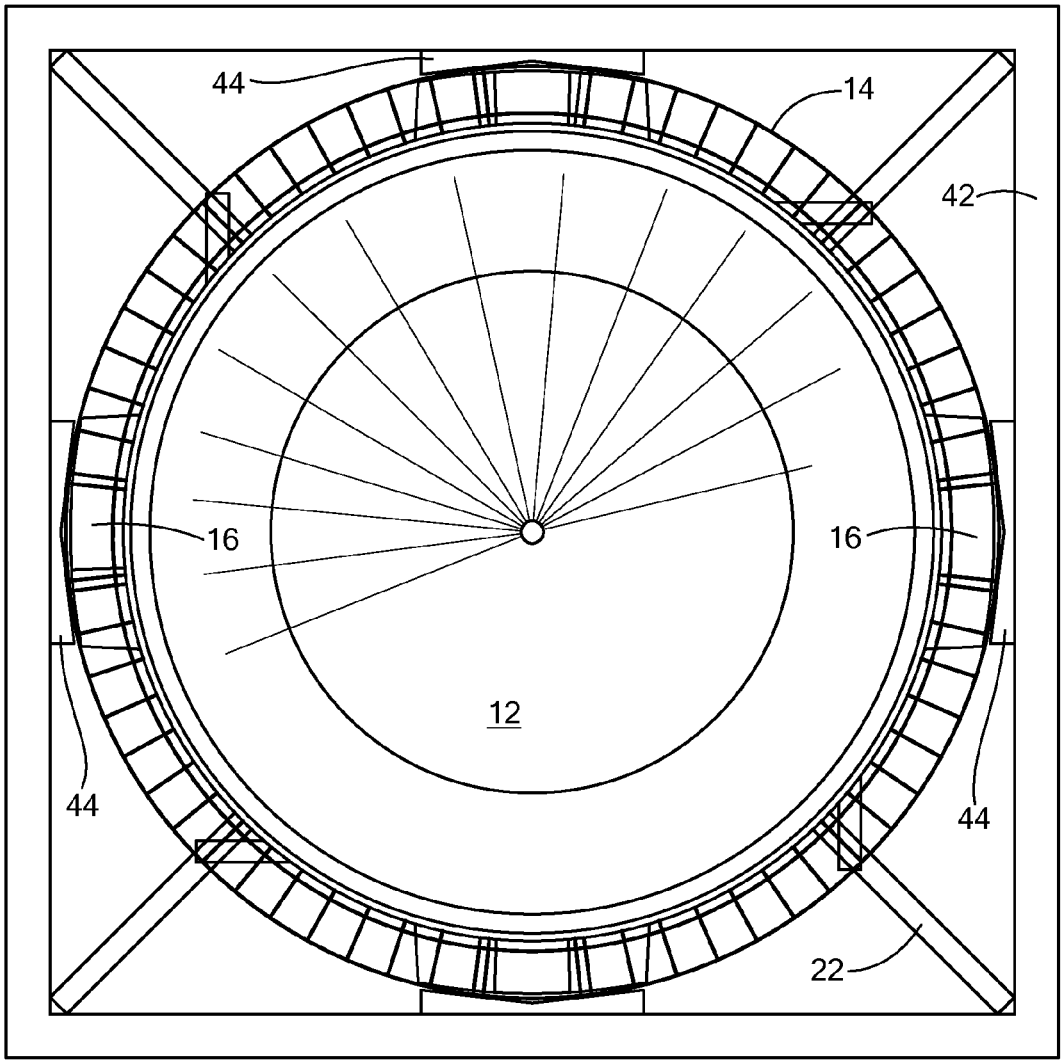
FIG. 4B is a rear view of the fluid borne-object of FIG. 4A.

The missile is illustrated in a launch canister 42 in FIGS. 4A and 4B. During launch, the stabilization device 14 rides along rails 44 having curved surfaces mounted to the inside of the canister. The stabilization device 14 has a curvature generally matching that of the rails and it rides along the rails with a minimal clearance during launch. The stabilization device provides enhanced stability for the missile inside the canister and during launch (prior to exiting the canister).

In the embodiment illustrated, the optional stabilization device 14 is formed as a ring extending radially from the circumference of the aft end of the nozzle extension 12. It will be appreciated that the stabilization device can have other configurations. For example, the stabilization device can be a partial ring or a number of discretely located hard points or tabs 14' that act to stabilize the missile in the canister. (See FIG. 5.) The stabilization device can be formed from any suitable material, including metals, plastics, or composite materials.

The grid fins 16 are preferably mounted to the stabilization device 14. The grid fins can alternatively be mounted to the nozzle extension 12, although the stabilization device typically provides greater structural support and thus forms a more preferred support. The grid fins are pivotably mounted to be folded forward against the nozzle extension during the stowed configuration.

After the missile exits the canister during launch, the grid fins flip or open to a deployed position and begin to control the flight path of the object, as is known in the art. FIG. 1B illustrates the grid fins in the open or deployed position. The grid fins can be mounted with a suitable biasing mechanism (not shown), such as a torsion spring device, which allows the grid fins to spring to the deployed position upon exiting the launch canister. Alternatively, an actuation mechanism (not shown) can be provided to deploy the grid fins upon command.

Figure 3B:
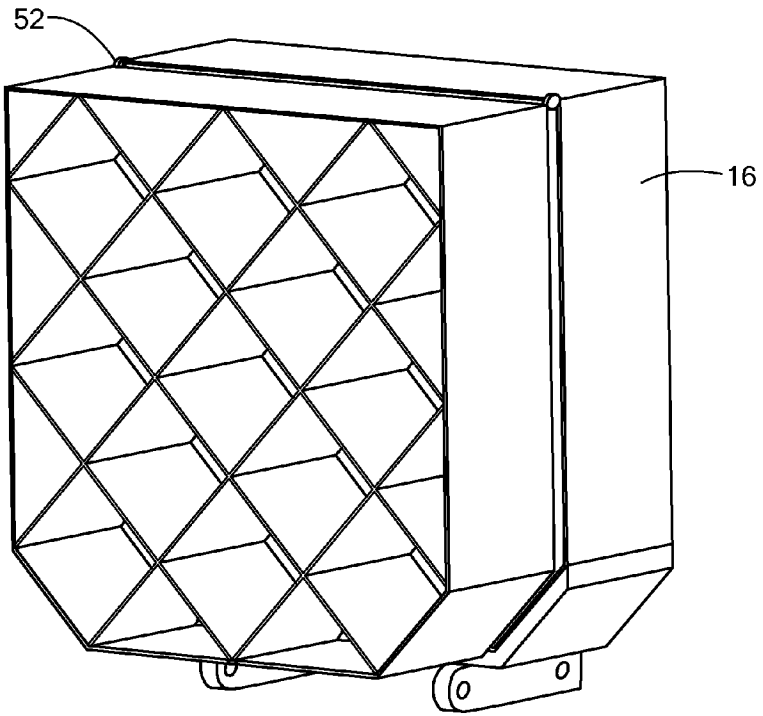
FIG. 3B is an isometric view of the hinged grid fin of FIG. 3A in a folded position.
Figure 3A:
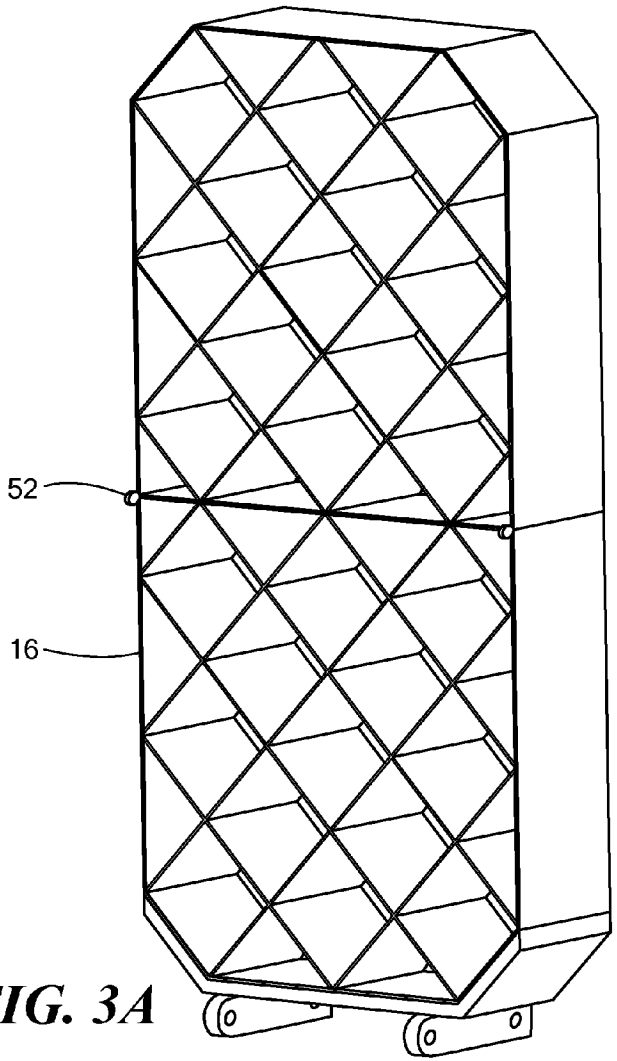
FIG. 3A is an isometric view of a hinged grid fin in a deployed position.

The grid fins 16 can be hinged in one or more intermediate locations 52, as illustrated in FIGS. 3A and 3B, to provide foldable grid fins. Hinging the grid fins allows them to be longer in the deployed position than the length of the nozzle extension. Preferably the hinge is formed of a simple torsion spring device, to minimize complexity and alterations to the aerodynamic surfaces of the grid fins, although any suitable actuating mechanism can be used, if desired. The grid fins can be fabricated from any suitable material, including metals, plastics, or composite materials.

What is claimed is:

1. A grid fin control system for a fluid borne-body comprising:

a nozzle extension mountable to a tail of the fluid-borne body, the nozzle extension extending rearwardly from the tail from a forward edge mounted on the tail to an aft edge;

a stabilization device mounted at the aft edge of the nozzle extension, the stabilization device extending radially outwardly from the nozzle extension; and a plurality of grid fins mounted to the stabilization device on the nozzle extension for movement from a stowed position folded against the nozzle extension and a deployed position extending radially outwardly from the nozzle extension.

2. The grid fin control system of claim 1, wherein the stabilization device comprises a ring extending around the circumference of the nozzle extension.

3. The grid fin control system of claim 1, wherein the stabilization device comprises a plurality of discretely located tabs on the nozzle extension.

4. The grid fin control system of claim 1, further comprising a mounting device for mounting the nozzle extension to the tail of the fluid-borne body.

5. The grid fin control system of claim 4, wherein the mounting device comprises a releasable mechanism for releasing the grid fin control system from the fluid-borne body.

6. The grid fin control system of claim 4, wherein the mounting device comprises a retaining mechanism for retaining the grid fin control system to the fluid-borne body.

7. A fluid-born body including the grid fin control system of claim 1, comprising:

an elongated body extending from a forward end to a tail, the grid fin control system mounted to the tail.

8. The fluid-born body of claim 7, further comprising a propulsion system disposed internally within the elongated body, and a nozzle disposed at an aft end of the elongated body, the grid fin control system mounted to the nozzle.

* * * * *